US011125237B1

(12) United States Patent
Aguilar

(10) Patent No.: US 11,125,237 B1
(45) Date of Patent: Sep. 21, 2021

(54) DRY PUMP BOOSTING SYSTEM

(71) Applicant: Narciso De Jesus Aguilar, Katy, TX (US)

(72) Inventor: Narciso De Jesus Aguilar, Katy, TX (US)

( * ) Notice: Subject to any disclaimer, the term of this patent is extended or adjusted under 35 U.S.C. 154(b) by 0 days.

(21) Appl. No.: 16/449,404

(22) Filed: Jun. 23, 2019

Related U.S. Application Data

(60) Provisional application No. 62/690,501, filed on Jun. 27, 2018.

(51) Int. Cl.
*F04D 17/16* (2006.01)
*F04D 29/44* (2006.01)

(52) U.S. Cl.
CPC ..... *F04D 17/16* (2013.01); *F04D 29/44* (2013.01); *F05D 2250/52* (2013.01)

(58) Field of Classification Search
CPC ..... F04D 1/006; F04D 1/025; F04D 13/02; F04D 13/04; F04D 13/043; F04D 17/16; F04D 17/18; F04D 17/025; F04D 25/045; F04D 25/024; F04D 29/2211; F04D 29/28; F04D 29/44; F05D 2250/52
See application file for complete search history.

(56) References Cited

U.S. PATENT DOCUMENTS 3,004,494 A * 10/1961 Corbett ..... F04D 9/04 417/245
5,156,534 A * 10/1992 Burgy ..... F02K 9/48 415/60
5,545,006 A * 8/1996 Agahi ..... F01D 1/14 415/169.2
7,517,186 B2 * 4/2009 Seitz ..... F04D 29/426 415/204
7,828,511 B1 * 11/2010 Pinera ..... F04D 13/043 415/72
7,931,441 B1 * 4/2011 Pinera ..... F04D 25/045 416/171

* cited by examiner

*Primary Examiner* — Igor Kershteyn

(57) ABSTRACT

The object of this invention is to create the elements necessary to supply lifting energy in a flowline or different recipients containing motionless fluids. The invention provides a motive force through an artifact comprising an aerodynamic housing connected to a scroll case, having a rotor comprised of two concentric arrays of external and internal blades. To operate, the artifact requires a source of fluid supply acting as motive fluid to boost or induce movement to a static or relative slow-motion fluid. The movement of the motionless fluid is produced by the acting force of the internal blades. Movement of the external blades is induced by the motive fluid entering the scroll case. The present invention can be utilized in different locations onshore and offshore (Shallow and Deepwater) in different positions, in order to support the transportation of fluids. The invention can be manufactured in different sizes to fit the system requirements. It can operate with any fluid supply such as gas or liquid or a mix of both. The artifact only requires a source of another fluid to produce the educing effect on the one which is desired to transport. It does not require direct sources of electrical power.

12 Claims, 16 Drawing Sheets

Perspective view showing Fluids Movement and a simplified design of the Rotor

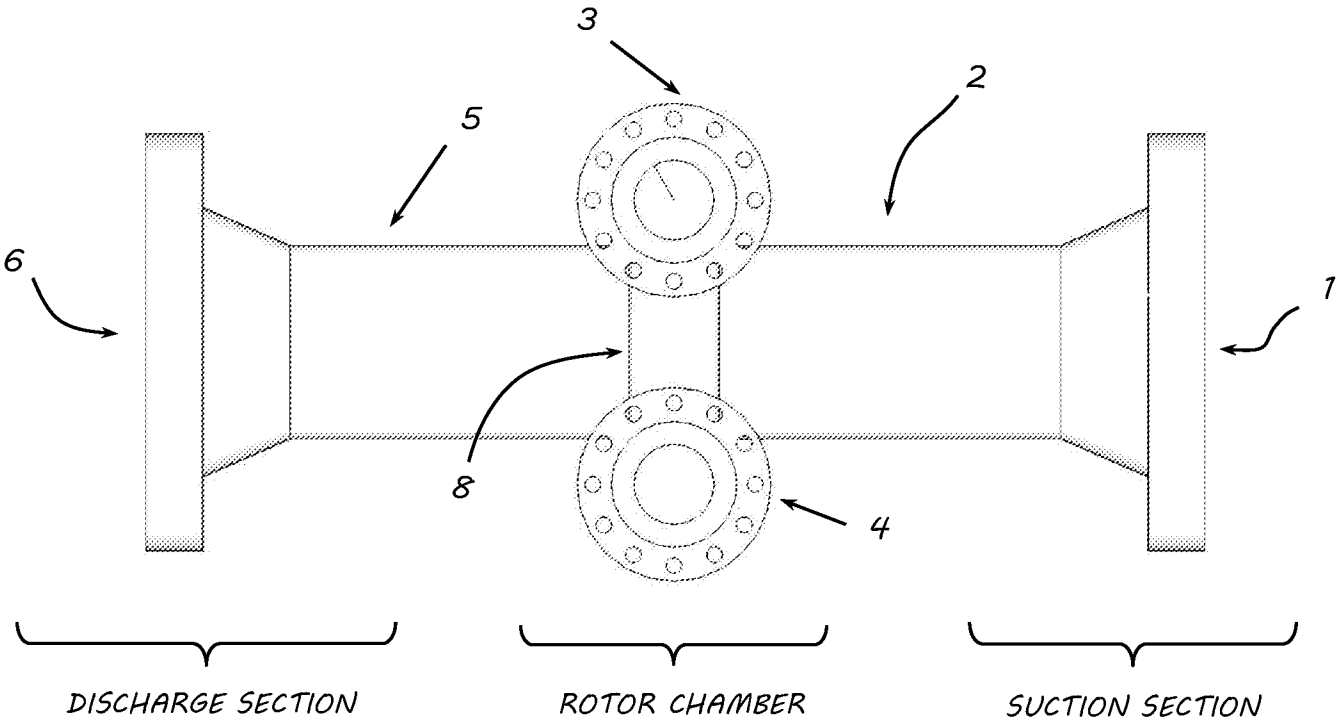
FIG. 1: Side Horizontal View of the Artifact showing External Discharge of Motive Fluid Outside the Scroll Casing

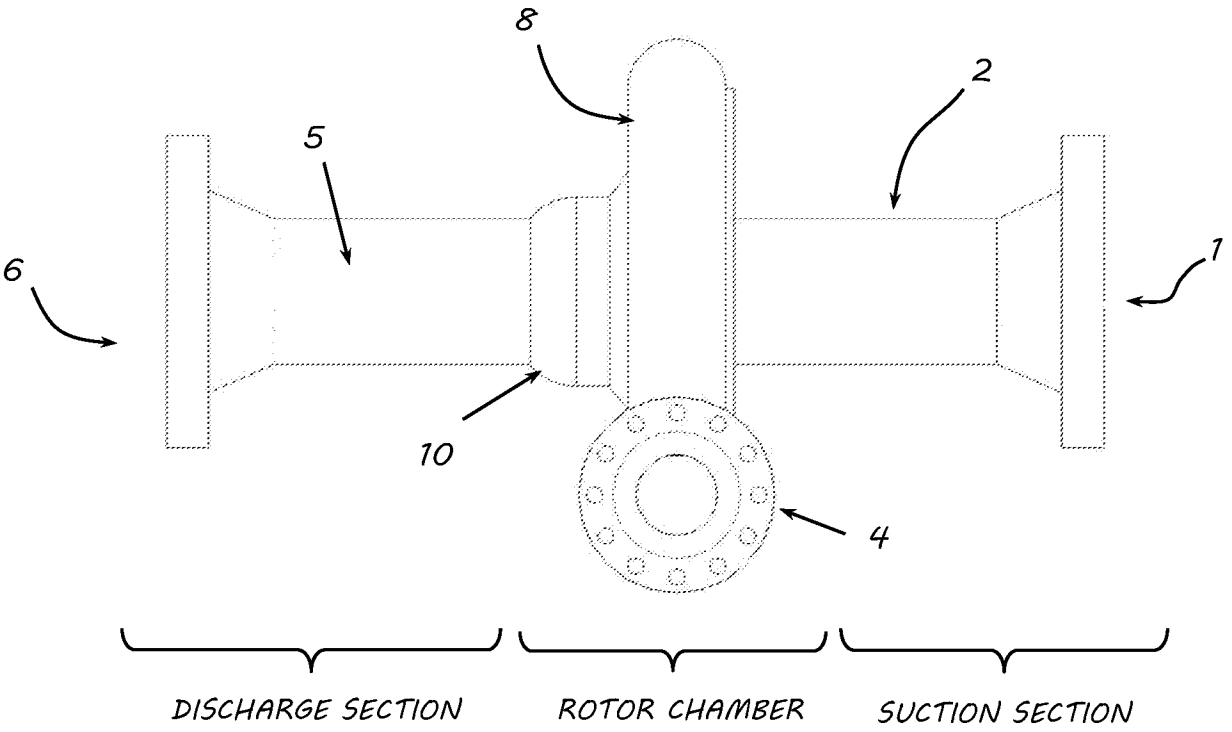
FIG. 2: Side Horizontal View of the Artifact showing Internal Discharge of Motive Fluid

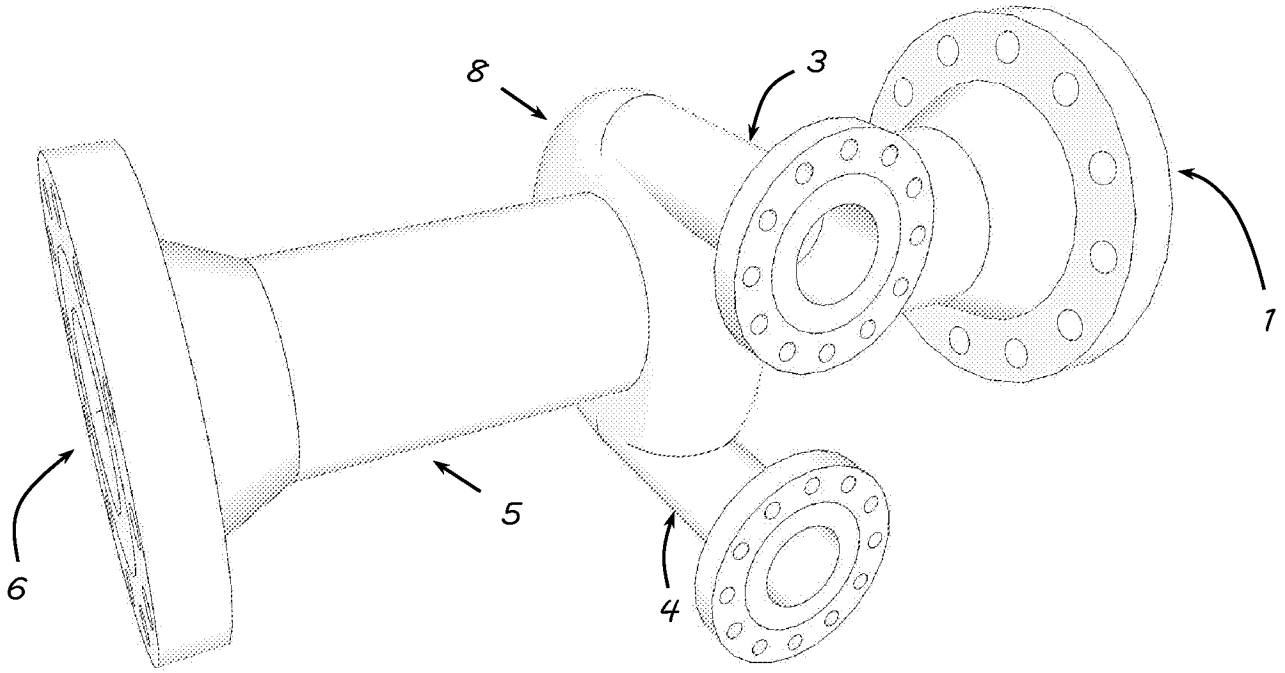
FIG. 3: Perspective view showing Inlet and External Discharge of the Motive Fluid and Suction and Outlet of Motionless Fluid

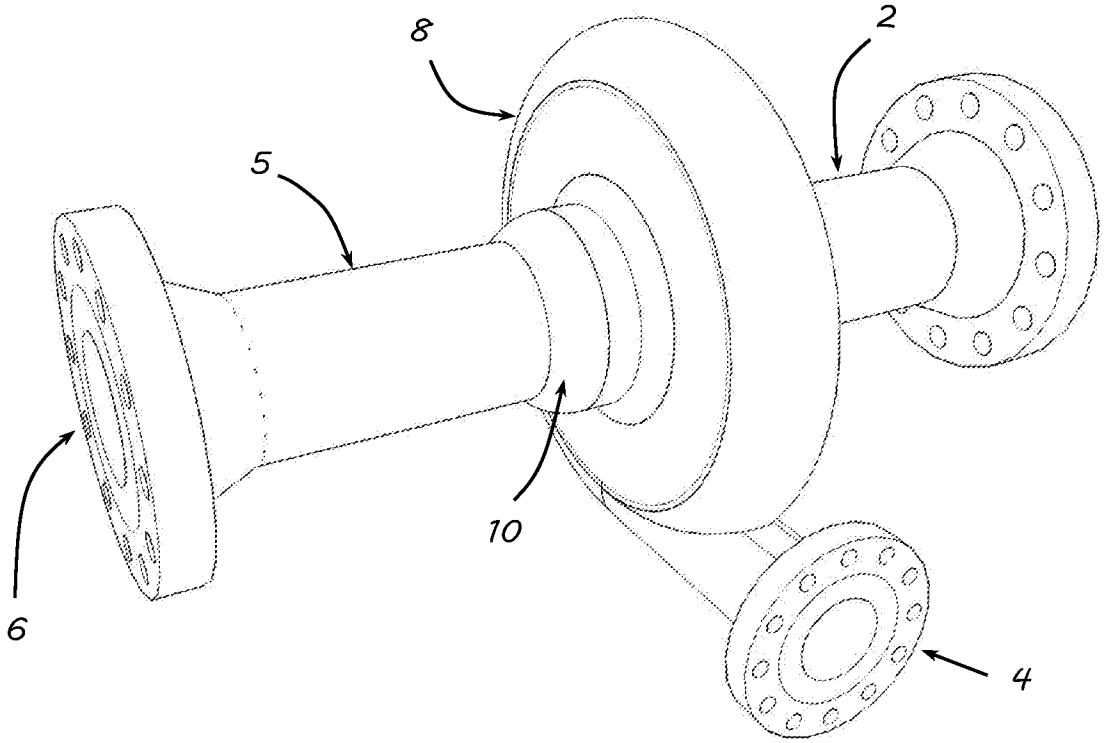
FIG. 4: Perspective view of the Boosting Artifact showing its Motive Fluid Discharge incorporated into its body

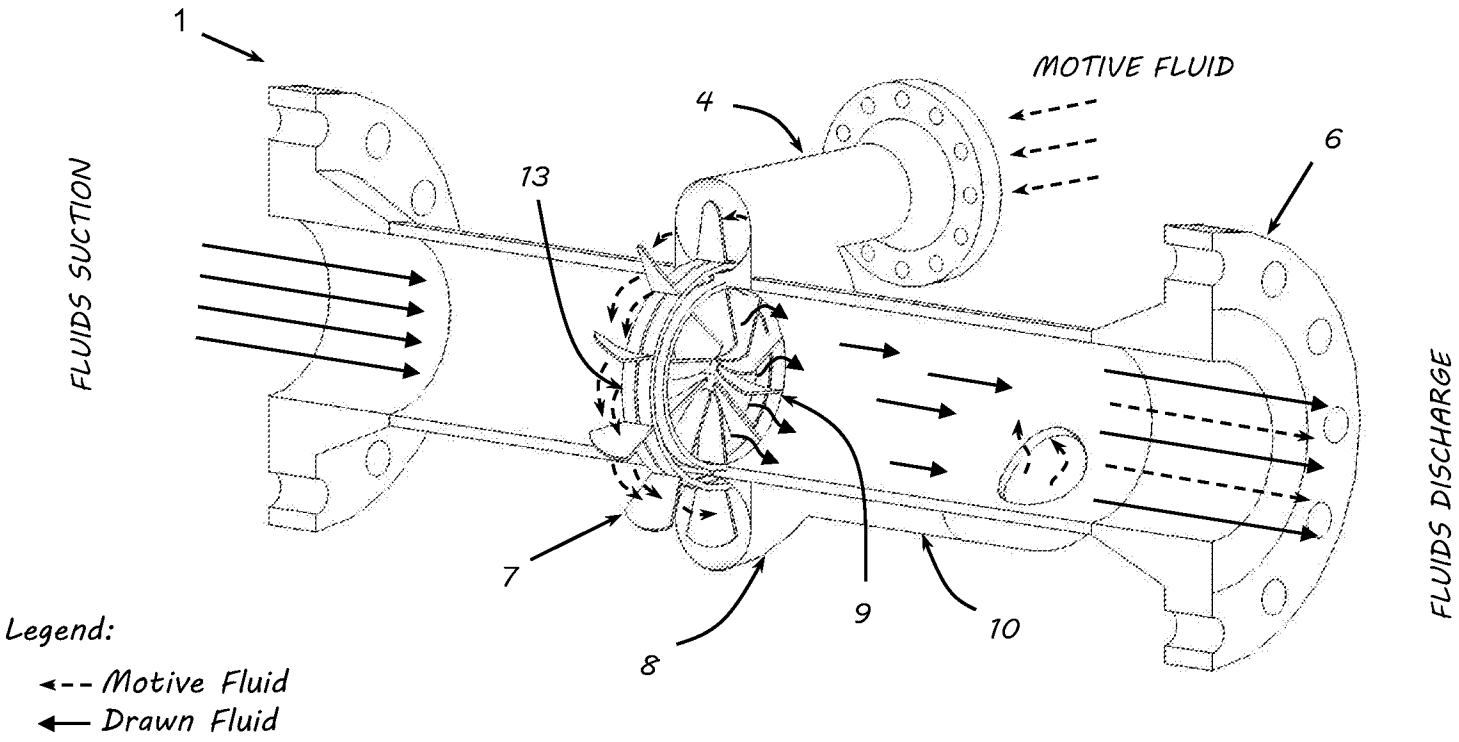
FIG. 5: Perspective view showing Fluids Movement and a simplified design of the Rotor

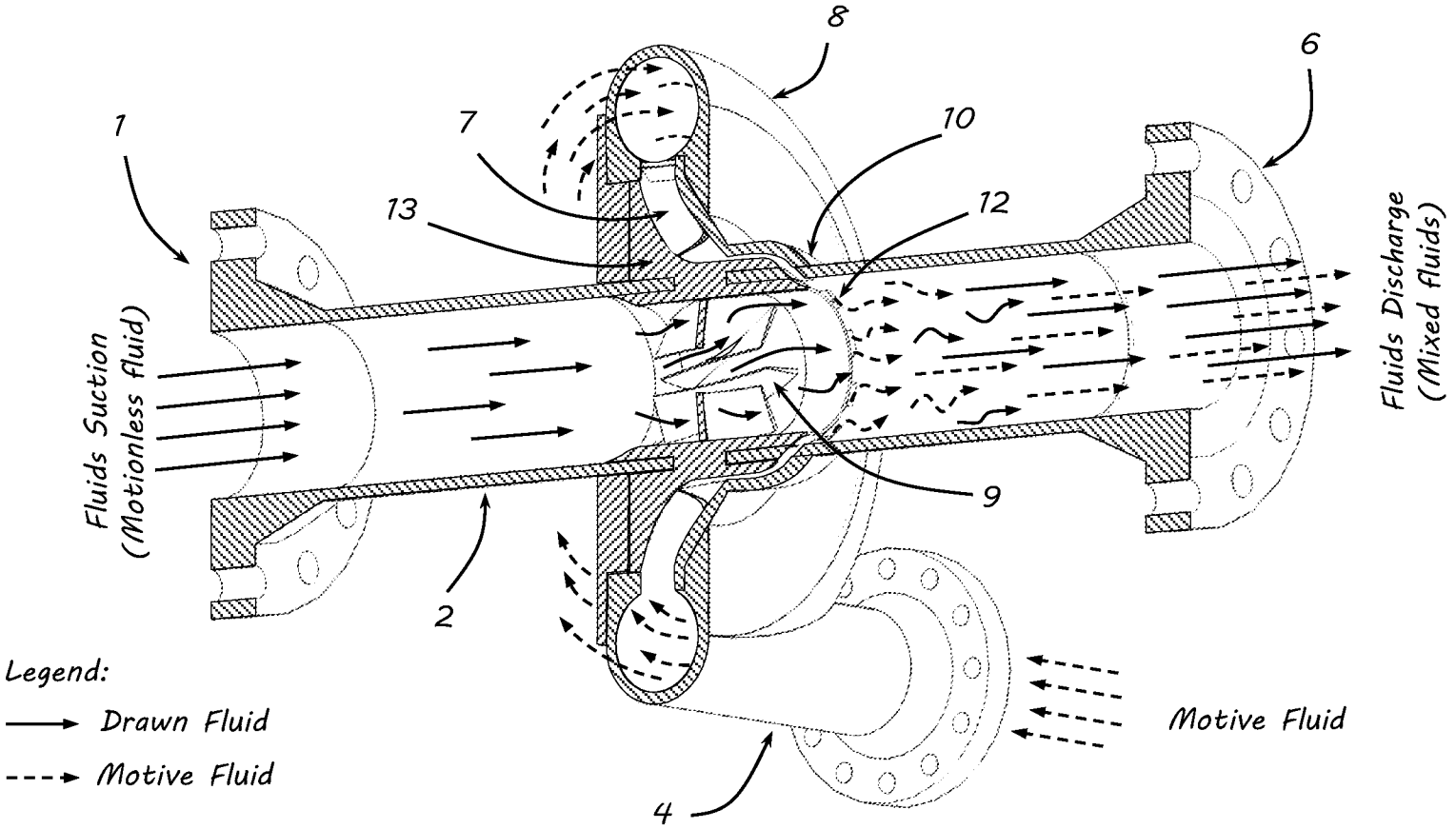
FIG. 6: Cross Section of the Artifact showing Movement Direction of the Motive and Drawn Fluids, and the Rotor

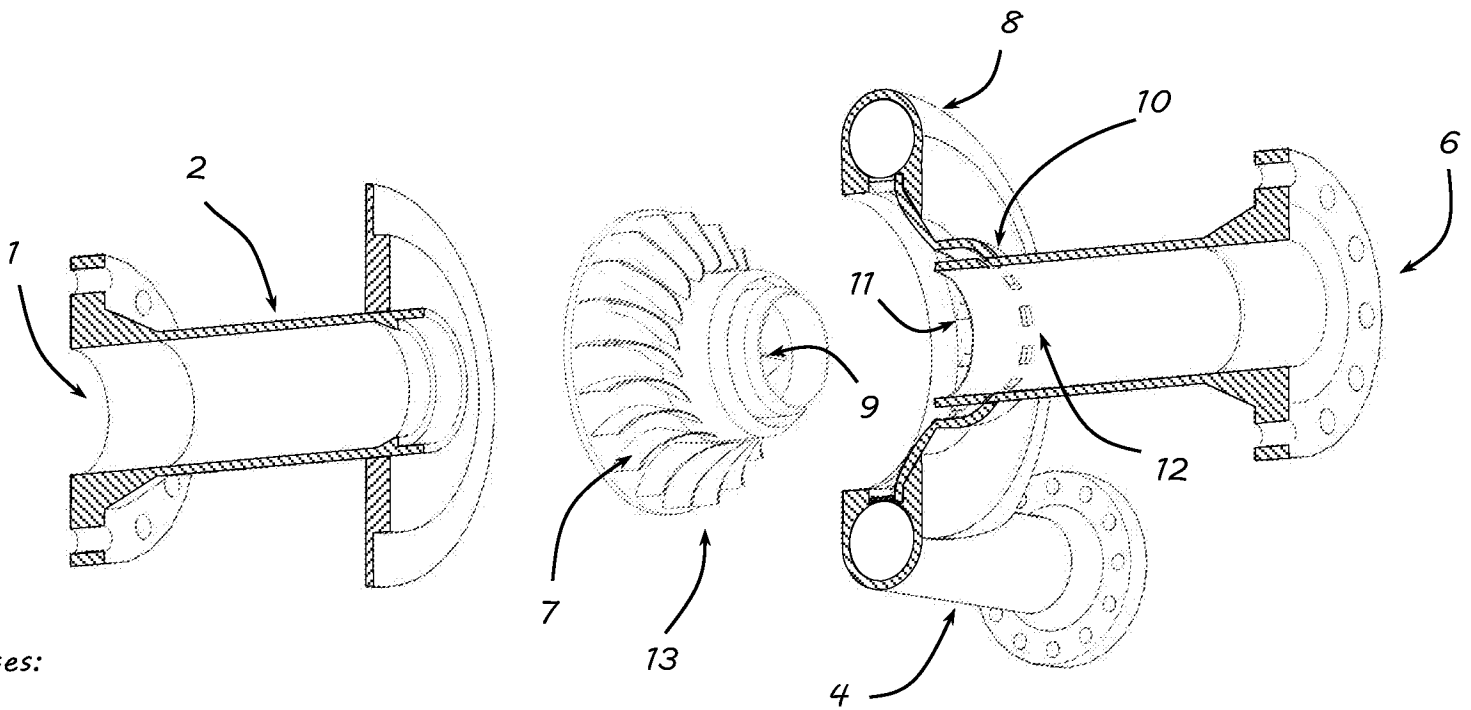
Notes:
The parts can be put together through welding or bolted joint
FIG. 7: Cross Section view of the Artifact showing a perspective view of the whole Rotor

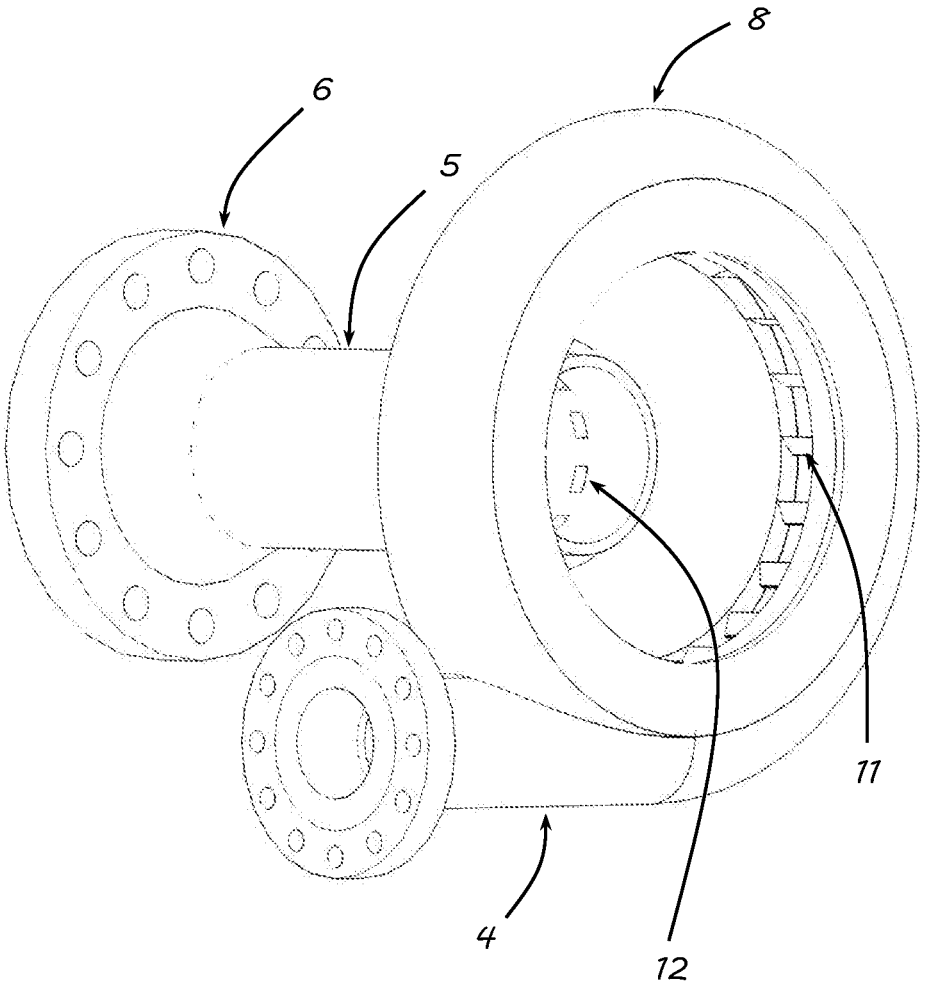
FIG. 8: Perspective View showing the Internal Motive Fluid Inlet and Internal Discharge, and Static Vanes

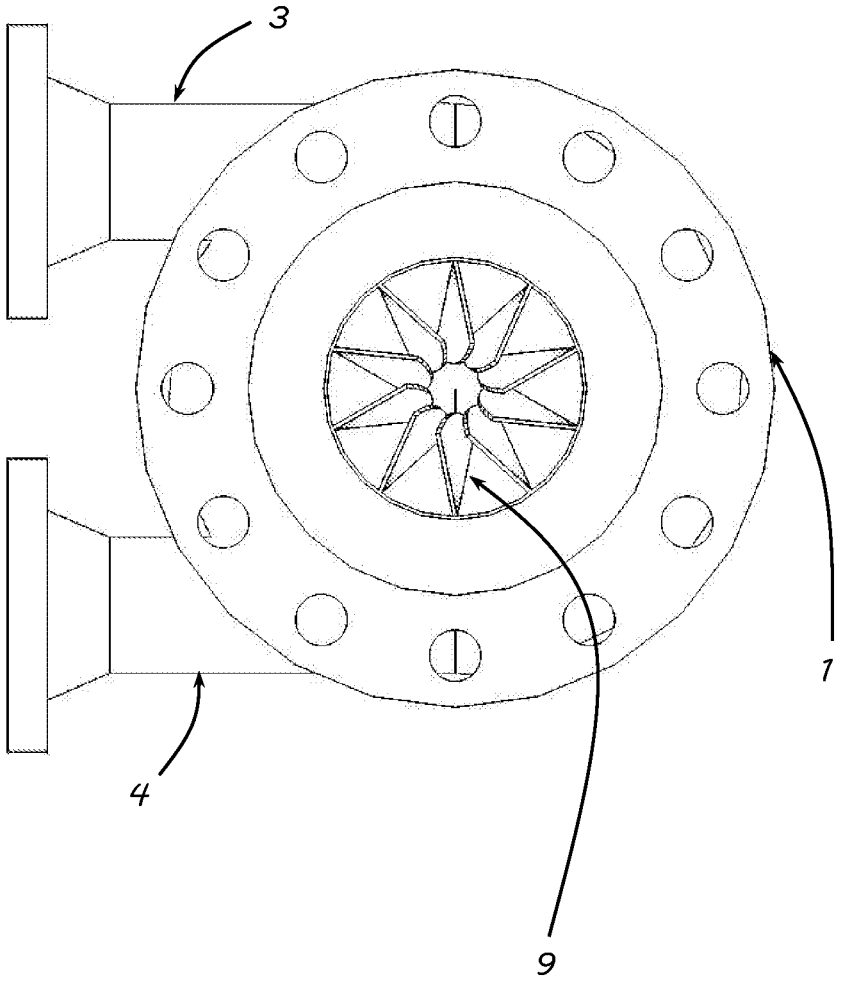
FIG. 9: View of the Artifact showing the Suction, the Motive Fluid Inlet and External Outlet, and a simplified design of the Internal Blades

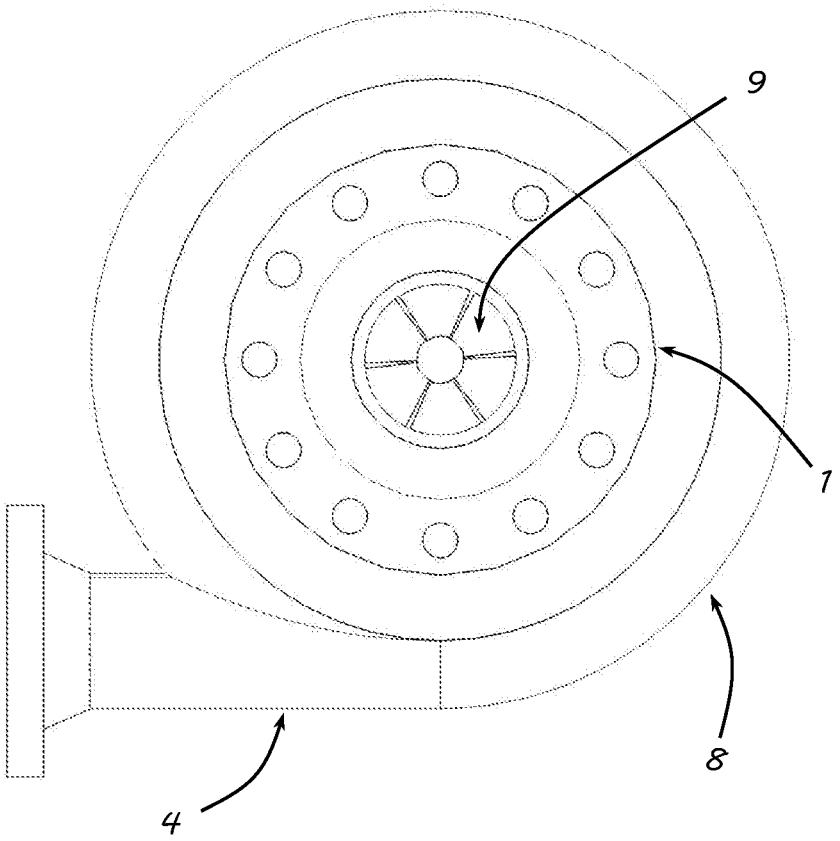
FIG. 10: View of the Artifact showing the Scroll Casing, Internal Blades and the Inlet and Suction of the Fluids

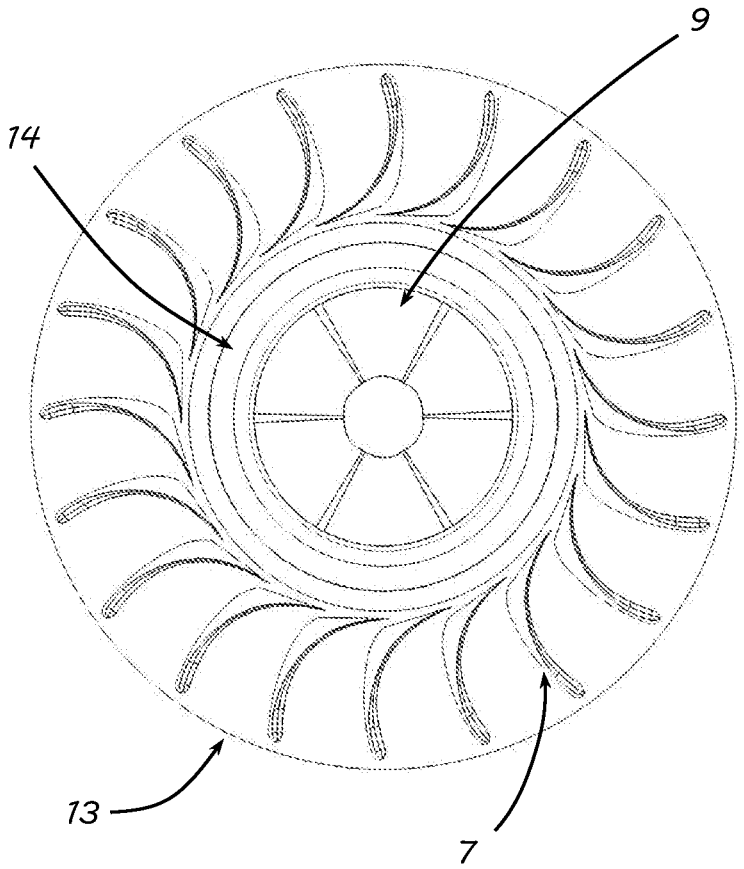
FIG. 11: Front View of the Rotor Showing its External and Internal Blades, and Seals Locations

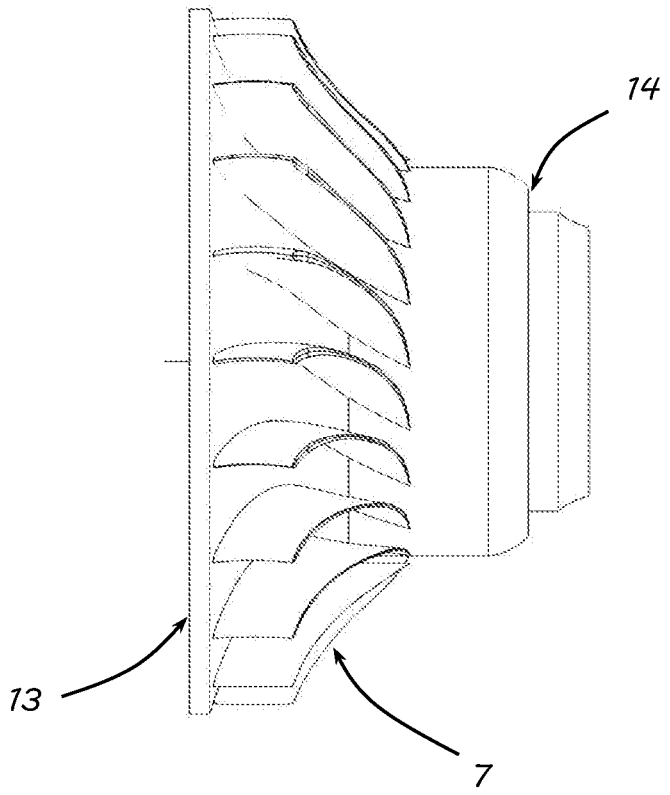
FIG. 12: Side View of the Rotor Showing its External Blades, and Seals Locations

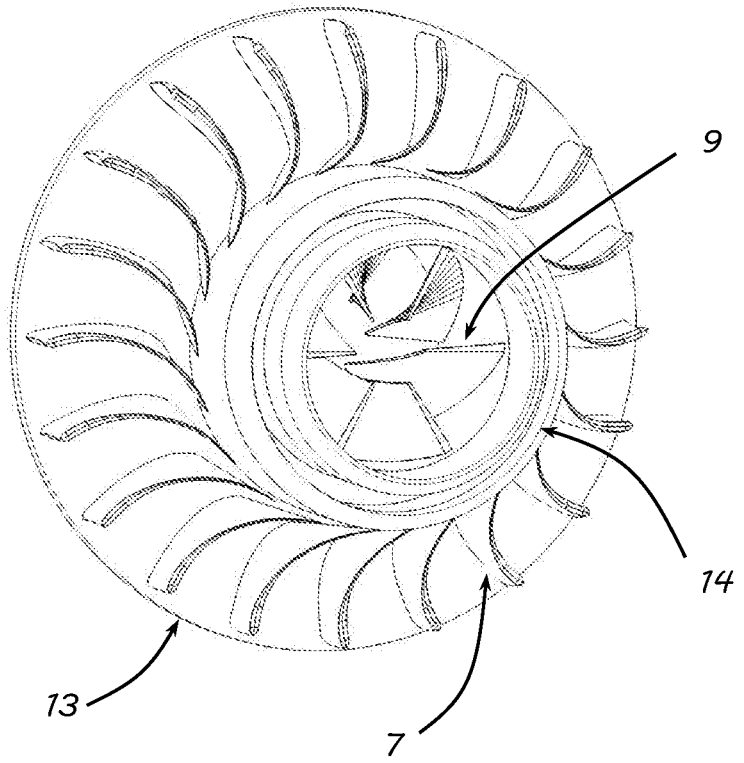
FIG. 13: Perspective View of the Rotor Showing its External and Internal Blades

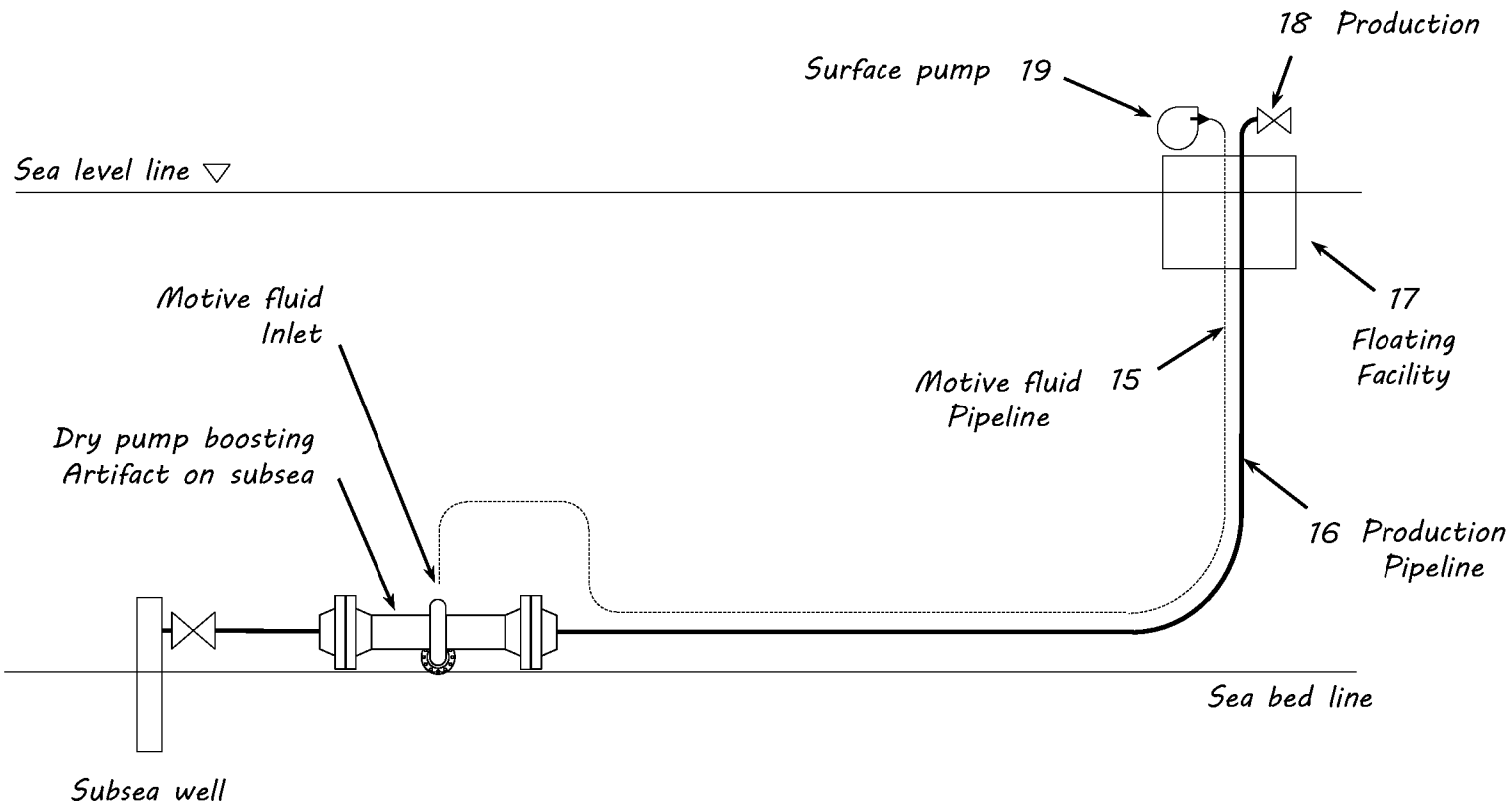
FIG. 14: Schematic Representation as a whole of the Dry Pump Boosting System, Including Surface Pump, Motive Fluid Pipeline and Dry Pump Boosting artifact on the seabed

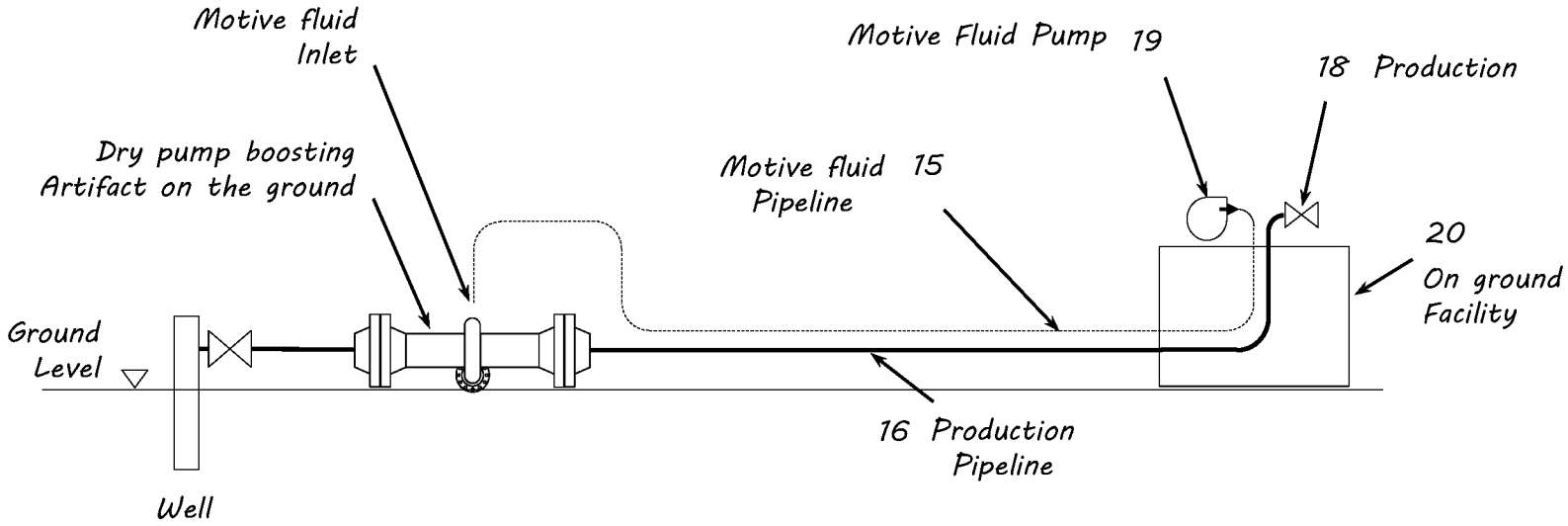
FIG. 15: Schematic Representation as a whole of the Dry Pump Boosting System, Including Motive Fluid Pump, Motive Fluid Pipeline and Dry Pump Boosting artifact on the ground

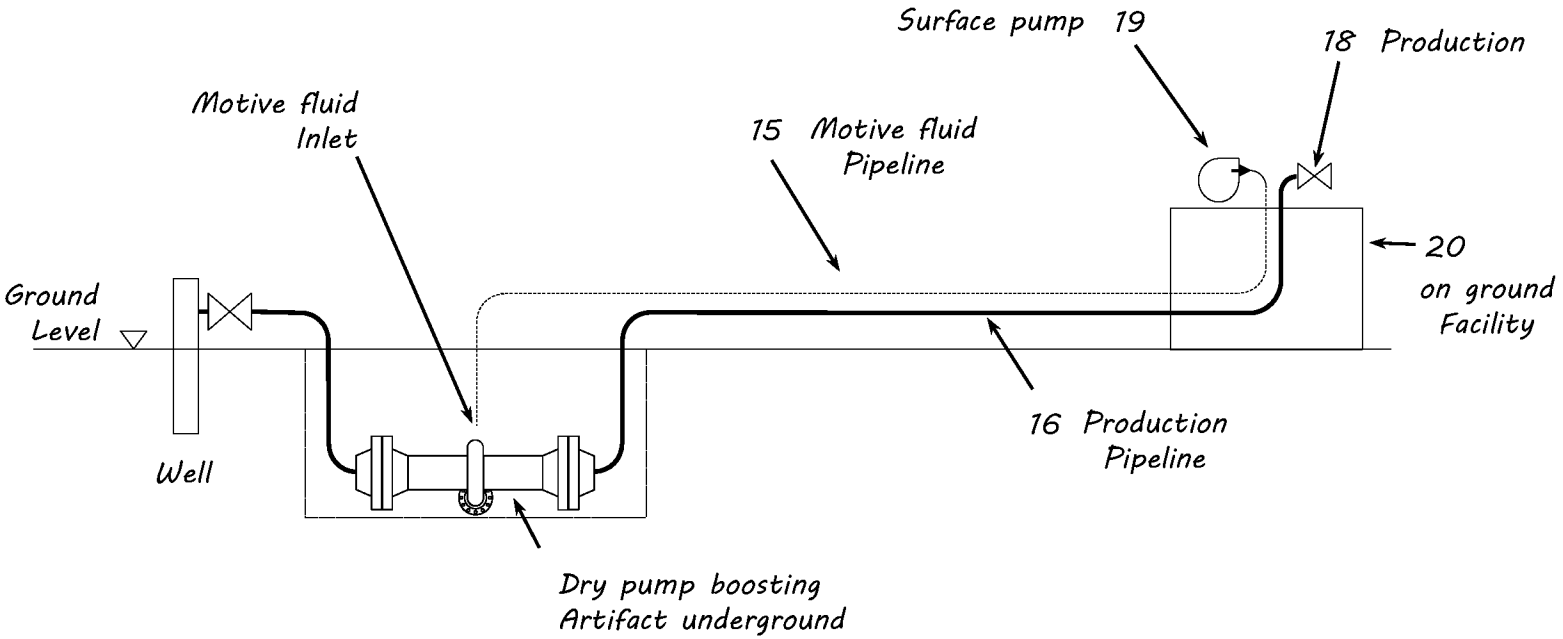
FIG. 16: Schematic Representation as a whole of the Dry Pump Boosting System, Including Surface Pump, Motive Fluid Pipeline and Dry Pump Boosting artifact underground

DRY PUMP BOOSTING SYSTEM

The object of the present invention is to create and put together the elements necessary to supply lifting energy in a flowline or different shaped recipients containing motionless fluid. The present invention provides a motive force through an artifact that can be fabricated in one or more bodies with few mobile parts, as necessary according the process where the artifact would be installed. To operate, the artifact requires a source of fluid supply acting as motive fluid in order to induce the movement of a static or relative slow motion, or motionless fluid. The seal between the rotor blades and the other sections prevent interaction of the fluids inside the artifact.

The rotor possesses two different concentric arrays of blades, one internal and another external. The movement of the motionless fluid is produced by the acting force of the internal rotor blades. The movement of the internal blades is induced by the motive fluid entering the scroll chamber of the artifact when it hit the external blades of the rotor. The resulting movement of the motionless fluid is axial or parallel to the body of the artifact.

The present invention can be utilized in different locations onshore and offshore (Shallow and Deepwater) and in different positions, in order to support the transportation of fluids. Some of these places can be flowlines, pipes, wells, tanks, raisers, etc. The invention can be manufactured in different sizes and shapes in order to fit the system requirements. It can be connected to a pipe coming from any other source and operated with any fluid supply such as gas or liquid according the final purpose.

CROSS-REFERENCE TO RELATED APPLICATIONS

The present invention can be used as a booster pump to support the transportation of low-pressure fluid systems, heavy density or viscous fluids. The motive fluid can be diverse, with a wide range of densities and viscosities, including gas and liquids.

STATEMENT REGARDING FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISC

Not Applicable

BACKGROUND OF THE INVENTION

1. Field of the Invention

The present invention is related with the use of a rotor with an array of concentric internal and external blades inside a housing body resembling a pipe, to exert force on a motionless or static fluid. The rotor is activated by one motive fluid when it hit the blades connected on the external side of the rotor. When the external blades of the rotor are hit by the motion fluid, it creates a rotating movement that will also move the internal blades at the same time, producing a vacuum force into the central cavity of the artifact, pushing and drawing forth out the motionless fluid inducing its movement.

The motive fluid can be discharged in two different ways from the artifact, one is using an external discharge nozzle connected externally to the scroll casing, and the other is using an internal discharge connected downstream of the rotor, where it will mix the motionless fluid, after this last one has been impulse by the internal blades of the rotor. If the fluids have different densities, the lighter fluid will reduce the density of the heavier fluid when they mix in the last section of the artifact, or vice versa. This effect will reduce the backpressure of the system containing the motionless fluid (drawn fluid) at the source.

The artifact has no direct power source such as electricity connected to it and it works resembling the propel blades without its hub, moving at the same velocity than the external blades are moving activated by a motive fluid. Particularly, the invention applies in the use of boosting any fluid from any pipe, oil flowlines, risers, etc., no matter their location, which can be onshore or offshore, including long distances tie-back in subsea applications or underground locations.

The artifact combines the pressure and velocity produced by the rotor blades to move and boost the fluid at higher pressure.

2. Background of the Related Art

The transportation of the fluids in a well, cylindrical vessel or pipe system depends of the pressure at the source or origin of such well, vessel or pipe system. This pressure can be produced by any mean natural or manufactured by man, and it must be enough to transport the fluid from one end to another in the well, vessel or pipe, and in many cases with enough discharge pressure to continue with another downstream process. For example, the transportation of fluids hydrocarbon in a well can involves different kind of technologies to makes the fluid flows to an end point at the surface, generally with a required discharge pressure. Such point can be located at the same level of the production facilities in the case of an onshore field, but it can also be necessary to makes the fluid flows up to a location or dry surface out of the subsea in case of an offshore facility. In some cases, the well should have enough pressure to make the fluid arrive to any desired destination. In other cases, the installation of systems such as seabed or mudline booster pumps help to reduce the backpressure on the well.

There are many ways to produce oil with different systems using booster pump methods. Generally, the system is part of the production facility from the first production date, but others, and particularly in the case of subsea facilities, many systems have multiphase pumps connected to the subsea manifolds which are installed far after the first production, in some cases when the reservoir has been depleted. Apart of oil, also gas and other fluids can be produced and introduced in many other ways into the transportation system.

The current invention can be used in many different situations in which the pressure at the source is insufficient to transport the fluid or when is required to reduce the density or induce movement to a fluid for its transportation, or evacuate a fluid from particular locations, including producing wells, transportation flowlines, transportation pipes or pipelines, confined spaces or vessels, subsea risers, etc.

The use of this artifact only requires a source of another fluid to produce the movement of the rotor with blades to move and pressurize the fluid desired to transport. It does not require direct sources of electrical power, so it can be implemented in many cases where the electrical power has limitations or does not exist.

BRIEF SUMMARY OF THE INVENTION

The object of the present invention is to provide a system artifact that utilizes no direct electrical power to move fluids throughout short or long distances. This is achieved using another fluid (drawer or motive fluid) as a medium at high pressure. The potential energy of the motive fluid is transformed into rotating kinetic energy on a rotor installed inside a scroll casing, when this hit its external blades. The motive fluid, may be generally less dense than the motionless fluid, so it will play additional functions such as a solvent that support the dilution or density reduction of the fluid drawn-out, and also it can work as a lifter in the case of gas which will support raising the heavier fluid once both fluids mix downstream the rotor, in the last section of the artifact. Lowing the density of the drawn fluid will reduce the backpressure at the source, which will make easier the transportation of the motionless fluid.

The invented artifact has an inlet and an outlet for the motive fluid, and a suction for the motionless fluid and one discharge, that can be common for both fluids (the motive fluid and the motionless one) when is desired. The inlet is dedicated to the motive fluid while the suction is dedicated to motionless or drawn fluid. The fluids are not in connection unless it is desired to mix them in the last section or discharge of the artifact. The artifact can be connected through piping or any other connection that allows bringing the drawer fluid until to and out of the artifact. Once the artifact is connected to the motive fluid source, it should be set to the rate and pressure required and placed at the desired location, which can be close or away from the source of fluid to drawn-out. The size, shape of the rotor and its blades, as wells as the exact location of the artifact must be calculated and designed according the process and fluids requirements. If the fluid to drawn-out is already in slow motion, the artifact should be placed in a convenient location according the process requirements to boost the fluid pressure, as necessary.

The drawer fluid to be used will depend of the application or process requirements. For most of the oil producing processes, the fluid to use can be gas, but it can be also low-density liquids, including water. The fluids can be separated, as required at the destination point, such as any of the separated fluids can be used in a loop as motive fluid, if desired.

The only thing the artifact requires for its operation is a motive fluid, which should have the required properties in according the process to be implemented. The artifact can be placed on the seabed at any depth or onshore, or underground at any point between the production and processing locations. It can also be placed in any location in a manufacturing facility to help to withdraw or evacuate any fluid in different processes.

The operation of the artifact can be done at the source of the motive fluid, where the flowrate and pressure will be set up. The rate and pressure may be eventually adjusted between periods of the time, in order to adapt the conditions to the process requirements. It can be also combined with control systems according the processes in the manufacturing or production facilities. The position of the artifact can also be adjusted according the variation of the conditions in the process. This will provide flexibility and continuity for longer periods of operation.

BRIEF DESCRIPTION OF THE DRAWINGS

To easier understand the nature and object of the current invention, reference is made to the accompanying drawings, in which:

FIG. 1 illustrates an external side view of the artifact in horizontal position, configured with motive fluid external outlet, showing its three main sections: the discharge tube section, the rotor chamber section or scroll casing, and the suction section.

FIG. 2 illustrates an external side view of the artifact in horizontal position, configured with motive fluid internal outlet, showing its three main sections: the discharge tube section, the rotor chamber section or scroll casing, and the suction section.

FIG. 3 illustrates a perspective picture of the artifact configured with motive fluid external outlet, showing its motive fluid inlet and outlet nozzles.

FIG. 4 illustrates a perspective picture of the artifact configured with motive fluid internal outlet, showing its Inlet, scroll case and motive fluid internal outlet chamber.

FIG. 5 illustrates a cross-section of the artifact configured with motive fluid internal outlet, including indication of the movement directions of the motive and drawn fluids. It also shows a perspective simplified design of the whole rotor with external and internal blades.

FIG. 6 illustrates a cross-section of the artifact configured with motive fluid internal outlet, including indication of the movement directions of the motive and drawn fluids. It also shows a cross section of the rotor with partial views of its external and internal blades.

FIG. 7 illustrates a cross-section of the artifact, configured with motive fluid internal outlet, split in three parts, including a perspective view of the rotor and the cross sections of the suction and discharge chambers.

FIG. 8 shows a perspective view of the scroll case together with the discharge chamber.

FIG. 9 is an axial view of the artifact configured with motive fluid external outlet, showing the suction end and a simplified design of the internal blades.

FIG. 10 is an axial view of the artifact configured with motive fluid internal outlet, showing the suction end and the internal blades, as well as the scroll case.

FIG. 11 illustrates a front view of the rotor showing its external and internal blades, and seals groove.

FIG. 12 shows a side view of the rotor where can be seen its external blades.

FIG. 13 shows a perspective view of the rotor where can be seen its external and internal blades.

FIG. 14 shows a schematic representation as a whole of the dry pump boosting system configured with motive fluid internal outlet, placed in a subsea environment.

FIG. 15 shows a schematic representation as a whole of the dry pump boosting system configured with motive fluid internal outlet, placed on an onshore environment.

FIG. 16 shows a schematic representation as a whole of the dry pump boosting system configured with motive fluid internal outlet, placed underground.

DETAILED DESCRIPTION OF THE INVENTION

Referring now in a detailed manner to the figures above, in which the numerals identify the parts of the artifact; the FIG. 1, represents a horizontal external side view of the boosting artifact of the present invention, configured with motive fluid external outlet. In this view are shown the suction 1 and the discharge 6 connections of the artifact, which are the connection ends of the artifact and can be jointed through different ways of connections, such as a flange, thread ends, or any other connection to a pipe or vessel. It also shows an external view of the motive fluid inlet 4 and external outlet 3 of the connected to the chamber of the rotor, through which the motive fluid enters and exits the scroll case 8 of the artifact to activate the movement of the rotor 13. It can be seen also the suction chamber 2 and the discharge chamber 5.

FIG. 2 represents a horizontal external side view of the boosting artifact of the present invention configured with motive fluid internal outlet. This view shows an external view of the motive fluid inlet 4 of the chamber of the rotor, through which the motive fluid enters the scroll case 8 to activate the movement of the rotor 13. In this configuration the motive fluid exits the rotor chamber through internal outlets orifices 12, so the fluids mix out once they reach the discharge chamber 5. The view shows the internal outlet chamber 10, and as in the previous figure it also shows the suction 1 and the discharge 6 connections of the artifact.

FIG. 3 illustrates a perspective view of the artifact configured with the motive fluid external outlet 3. On the view can be seen the suction connection 1 of the artifact, the motive fluid inlet 4, the discharge chamber 5, and the discharge connection 6.

FIG. 4 illustrates a perspective view of the artifact configured with motive fluid internal outlet. On the view can be seen the suction connection 1 of the artifact, the motive fluid inlet 4, the motive fluid internal outlet chamber 10, the scroll case 8, the discharge chamber 5, the suction chamber 2, and the discharge connection 6.

FIG. 5 illustrates in perspective a cross section of the artifact, configured with motive fluid internal outlet. It shows the direction of the motive and drawn fluids inside the artifact. The continue line arrows show the approximate direction of the drawn fluid while the dashed line arrows show the approximate direction of the motive fluid. It also shows a perspective view of a simplified design of the rotor 13, and a simplified design array of its internal blades 9 and external blades 7. It can be seen the motive fluid inlet 4 located at the top of the artifact and how the motive fluid travels through the external blades 9 in the scroll casing 8 inducing movement on the rotor 13 to produce movement onto the motionless fluid. It also shows a simplified design of the motive fluid internal outlet chamber 10.

As in the previous figure, FIG. 6 illustrates in perspective a cross section of the artifact, configured with motive fluid internal outlet. It shows the directions of the motive and drawn fluids inside the artifact. The continue line arrows show the approximate direction of the drawn fluid while the dashed line arrows show the approximate direction of the motive fluid. It also shows the location of the rotor 13, and a partial view of the design array of its internal blades 9 and external blades 7. It can be seen the motive fluid inlet 4 located at the bottom of the artifact and how the motive fluid travels from the scroll casing 8 through the internal blades 9 to produce movement onto the rotor. It can be seen how the motive fluid passes from the scroll case 8 through the external blades 9 to the motive fluid internal outlet chamber 10, and exit throughout the internal outlet orifices 12. Then the motive fluid joins the motionless fluid after this is drawn by the internal blades 7, to both be mixed into the discharge chamber 5.

FIG. 7 shows a perspective view of the boosting artifact split in three parts to show some details that cannot be seen in previous figures. It shows a cross section of the suction chamber 2 and a cross section of the discharge chamber 5 together with the scroll case 8. In the middle can be seen a perspective view of the rotor 13, showing its external blades 7 and a partial view of its internal blades 9. On the discharge section 5 can be seen the motive fluid internal outlet orifices 12. And in the scroll case 8 can be seen partially the scroll deflector elements 11.

FIG. 8 shows a perspective view of the scroll case 8 together with the discharge chamber 5. Inside the scroll case 8 can be seen the scroll deflector elements 11. Inside the discharge section 5 can be seen the motive fluid internal outlet orifices 12.

The FIG. 9 shows an axial view of the artifact configured with motive fluid external outlet, where can be seen the suction 1, the motive fluid inlet 4, the motive fluid external outlet 3, and a simplified design of the internal blades 9.

The FIG. 10 shows an axial view of the artifact configured with motive fluid internal outlet, where can be seen the suction 1, the scroll case 8, the motive fluid inlet 4, and the internal blades 9.

The FIG. 11 shows a front view of the rotor 13, where can be seen the external blades 7, the internal blades 9 and the seals groove 14. The shape, amount and direction of these blades have to be designed according the fluids characteristics and process requirement.

The FIG. 12 shows a side view of the rotor 13, where can be seen the external blades 7 and the location of the seals groove 14.

The FIG. 13 shows a perspective view of the rotor 13, where can be seen the external blades 7, the internal blades 9 and the seals groove 14.

FIG. 14 shows Schematic Representation as a whole of the Dry Pump Boosting System circuit on an offshore environment, including: Surface Pump 19 which will impulse the motive fluid from a remote location, Motive Fluid Pipeline 15 which will transport the motive fluid, production pipeline 16, a floating facility 17 where all surface facilities are installed, the production discharge 18, and the Boosting Artifact configured with motive fluid internal outlet, placed on the seabed surface. When the boosting artifact is configured with external outlet, it can be incorporated an additional pipeline for the discharge of the motive fluid segregated from the production pipeline 16.

FIG. 15 shows Schematic Representation as a whole of the Dry Pump Boosting System circuit on an onshore environment, including: Surface Pump 19 which will impulse the motive fluid from a remote location, Motive Fluid Pipeline 15 which will transport the motive fluid, production pipeline 16, a ground located facility 20 where all surface facilities are installed, the production discharge 18, and the Boosting Artifact configured with motive fluid internal outlet, placed on the ground. When the boosting artifact is configured with external outlet, it can be incorporated an additional pipeline for the discharge of the motive fluid segregated from the production pipeline 16.

FIG. 16 shows Schematic Representation as a whole of the Dry Pump Boosting System circuit on an underground environment, including: Surface Pump 19 which will impulse the motive fluid from a remote location, Motive Fluid Pipeline 15 which will transport the motive fluid, production pipeline 16, a ground facility 20 where all surface facilities are installed, the production discharge 18, and the Boosting Artifact configured with motive fluid internal outlet, placed underground or buried. When the boosting artifact is configured with external outlet, it can be incorporated an additional pipeline for the discharge of the motive fluid segregated from the production pipeline 16.

The invention claimed is:

1. An artifact for boosting fluids:

an aerodynamic cylindrical housing having a suction and a discharge at the ends, the aerodynamic spiral or scroll case having an internal hollow chamber, the internal hollow chamber having at least one nozzle, the at least one nozzle serving for receiving a motive fluid or for discharging a motive fluid; the aerodynamic spiral or scroll case surrounds a rotor comprised of two concentric arrays of external and internal blades, which are moved by a motive fluid, the rotor placed inside the scroll case hollow chamber to draw out a motionless fluid, from the suction to the discharge of the artifact; wherein the spiral or scroll case is shaped to direct the motive fluid toward the external blades such as to cause the movement of the rotor; the scroll case contains fixed deflector elements installed inside, which act as elements that guide and distribute the motive fluid uniformly along an internal hollow chamber.

2. The artifact described in claim 1 comprising an inlet nozzle for the motive fluid, which delivers the motive fluid internally through internal outlet orifices toward the discharge.

3. The artifact described in claim 2, further comprising two nozzles, one for motive fluid inlet and another for motive fluid outlet.

4. The artifact described in claim 3, further comprising the inlet nozzle receiving the motive fluid, and delivers the motive fluid internally through internal outlet orifices toward the discharge section.

5. The artifact described in claim 1 having two nozzles, one for motive fluid inlet and another for motive fluid outlet.

6. The artifact described in claim 1, further comprising the rotor having two concentric external and internal arrays of blades, each blade having a hydrofoil or an airfoil shape which allowing the fluid increase velocity when pass through the blades, producing a pressure boosting effect on the fluid.

7. A fluids transportation system connected in a circuit as a whole, comprising the artifact described in claim 2 or claim 3, installed on the subsea, or installed onshore or installed underground, a motive fluid transportation pipeline, a discharge pipeline to transport the motive fluid to its final destination, an externally powered surface pumping system to impulse the motive fluid connected to the artifact, and a production pipeline to transport the motionless fluid, all connected in circuit.

8. A fluids transportation system connected in a circuit as a whole, comprising the artifact described in claim 2 or claim 3, installed on the subsea, or installed onshore or installed underground, a motive fluid transportation pipeline, an externally powered surface pumping system to impulse the motive fluid connected to the artifact, and a production pipeline to transport the mixture of the motive and the motionless fluids, all connected in circuit.

9. A process to boost or increase pressure in a pipeline or vessel system containing a fluid, using the artifact described in claim 1, using a motive fluid moved by an external powered equipment placed away from the location of the artifact.

10. A process to boost or increase pressure in a pipeline or vessel system transporting fluid or mix of fluids, with the artifact described in claim 1, using a motive fluid moved by an external powered equipment placed away from the location of the artifact.

11. A fluids transportation system connected in a circuit as a whole, comprising one or more of the artifact described in claim 2 or claim 3, installed on the subsea, or installed onshore or installed underground, a motive fluid transportation pipeline, a discharge pipeline to transport the motive fluid to its final destination, an externally powered surface pumping system to impulse the motive fluid connected to the artifact, and a production pipeline to transport the motionless fluid, all connected in circuit.

12. A fluids transportation system connected in a circuit as a whole, comprising one or more of the artifact described in claim 2 or claim 3 connected in series, installed on the subsea, or installed onshore or installed underground, a motive fluid transportation pipeline, an externally powered surface pumping system to impulse the motive fluid connected to the artifact, and a production pipeline to transport the mixture of the motive and the motionless fluids, all connected in circuit.

* * * * *